US008172160B2

(12) United States Patent
Simon et al.

(10) Patent No.: US 8,172,160 B2
(45) Date of Patent: May 8, 2012

(54) METHOD AND DEVICE FOR DISPERSING A LIQUID FOR USE IN FOGGING

(76) Inventors: François Simon, Meudon (FR); Sandre Simon, Meudon (FR)

( * ) Notice: Subject to any disclaimer, the term of this patent is extended or adjusted under 35 U.S.C. 154(b) by 394 days.

(21) Appl. No.: 11/994,399

(22) PCT Filed: Jun. 29, 2006

(86) PCT No.: PCT/FR2006/001568

§ 371 (c)(1),
(2), (4) Date: Jun. 2, 2008

(87) PCT Pub. No.: WO2007/003794

PCT Pub. Date: Jan. 11, 2007

(65) Prior Publication Data

US 2008/0245884 A1 Oct. 9, 2008

(30) Foreign Application Priority Data

Jul. 1, 2005 (FR) ..... 05 07097
Apr. 14, 2006 (FR) ..... 06 03598

(51) Int. Cl.
*B05B 17/04* (2006.01)

(52) U.S. Cl. ..... 239/7; 239/145; 239/214; 239/215; 239/222.11; 239/224; 239/345; 239/575; 239/590

(58) Field of Classification Search ..... 239/7, 145, 239/214, 215, 222.11, 223, 224, 263.1, 345, 239/379, 575, 553, 553.3, 590, 590.3
See application file for complete search history.

(56) References Cited

U.S. PATENT DOCUMENTS

| | | | | |
|---|---|---|---|---|
| 2,126,959 A | | 8/1938 | Heuer | |
| 2,417,929 A | | 3/1944 | Hanson | |
| 3,459,586 A | * | 8/1969 | Virta, Sr. et al. | 239/224 |
| 4,019,684 A | * | 4/1977 | Parkin | 239/145 |
| 5,727,541 A | | 3/1998 | Rowland et al. | |
| 6,098,895 A | * | 8/2000 | Walzel et al. | 239/7 |

FOREIGN PATENT DOCUMENTS

| | | |
|---|---|---|
| DE | 10241439 A1 | 3/2004 |
| EP | 0552089 A | 7/1993 |
| FR | 2797189 A | 2/2001 |
| GB | 1486427 A | 9/1977 |
| GB | 2043489 A | 10/1980 |
| SU | 1171100 A | 8/1985 |

* cited by examiner

*Primary Examiner* — Steven J Ganey
(74) *Attorney, Agent, or Firm* — Browdy and Neimark, PLLC

(57) ABSTRACT

The invention concerns a device comprising a rotary body (1) made of a fibrous or porous material, means for rotating (3, 4) said body (1) and means for inputting liquid (10, 11) contacting said body (1), so as to subject said liquid to the dispersing action of forces at the liquid/solid interface, and to rotate the body (1) so as to subject the comminuted liquid to a centrifugal force.

26 Claims, 3 Drawing Sheets

METHOD AND DEVICE FOR DISPERSING A LIQUID FOR USE IN FOGGING

BACKGROUND OF THE INVENTION

1. Field of Invention

The present invention relates to a method and device to disperse a liquid which can be used in particular, but not exclusively, for mist propagation i.e. the dispersion of the liquid in droplets of adjustable size, ranging from fine, ultra-fine droplets to a stage very close to vaporization.

2. Description of the Prior Art

Generally, it is known that to disperse a liquid mass, devices are usually used which have recourse to high pressure pumps feeding spray nozzles, optionally assisted by ultrasound. Another solution consists in using jets of compressed air used to fragment the liquid phase e.g. similar to a paint gun or airbrush.

At all events, they are complex devices, delicate to regulate and relatively costly. In addition, they require particularly demanding maintenance (risks of clogging), they are very difficult to adjust and require a relatively high energy supply.

OBJECT OF THE INVENTION

One particular purpose of the invention therefore is to solve these problems and to reduce these drawbacks so as to obtain simple, efficient dispersion devices which are easy to maintain and yet low cost.

SUMMARY OF THE INVENTION

For this purpose it proposes a dispersion method consisting of subjecting the liquid both to the dispersing action of forces which develop spontaneously at the interface between a liquid and a solid, such as a capillary force for example, and of causing the solid to rotate so as to subject the fragmented liquid to a centrifugal force causing its extraction and spraying in the surrounding medium in the form of drops, droplets, ultra-fine droplets, vapour.

Advantageously the supply of liquid to the solid can be ensured either:

- by aspiration due to centrifugal force;
- by capillarity, by means of a material that is porous or fibrous or powdery for example, having the required affinities with the liquid so that the phenomenon of capillarity can develop,
- by pumping, using pumping means, or
- by gravity e.g. using a drip.

Also the above-said solid may be heterogeneous and may comprise a fraction exerting an interactive attraction force on the liquid, and a fraction exerting an interactive repelling force on the liquid.

Additionally, having regard to the fact that the solid is caused to rotate, it is possible by means of a particular conformation of the solid and/or of additional elements associated with it, to set up an air stream which, when applied to the fragmented or vaporized liquid, completes the dispersion of the liquid in the surrounding medium.

Therefore, fragmentation may be applied to a larger volume of surrounding medium.

Evidently, the invention concerns devices to implement the method just described.

These devices therefore have recourse to a rotating body in a solid material, rigid or flexible, which may for example be fibrous (micro-fibrous), porous, cellular or micro-cellular, to means for driving said body in rotation and to liquid intake means in contact with said body.

Preferably, the body may have symmetrical outer shapes relative to its axis of rotation.

The radial faces of the body may be at least partly coated or impregnated with a sealing layer.

The body may be rotatably mounted via a hollow drive shaft used to supply it with liquid. In this case, the liquid intake may be obtained by means of the aspiration generated by the centrifugal forces exerted on the liquid inside the body and/or by assistance means using capillarity and/or pumping means.

As a variant, the intake of liquid on the body may be made under gravity, by means of a dispenser e.g. of drip type arranged above the body.

It has been found that if the rotating body is a porous or fibrous body having orifices on its periphery for the passing of liquid, the size of the droplets generated during rotation is variable in relation to the size and shape of these orifices.

Having regard to this finding, the invention provides for the use of a body in compressible material, and for the adjustment of this size and shape:

- either by an adjustable, permanent mechanical action exerted on the body to cause compression or expansion of the body material at least at its periphery,
- or by automatic or automated action, such as servo-control by a parameter such as the speed of rotation of the body, in particular so that it is possible to adjust the size of the droplets in relation to this parameter e.g. the rotating speed of the body.

Additionally, the device of the invention may comprise means allowing an airflow to be generated so as to channel the fog generated by the body, particularly for an application such as painting or phytosanitary treatment. In this case, deflection means may be provided so that the channelled fog has a circular or rectangular section similar to a conventional brush.

Advantageously:

- Said above body may be arranged between two disks variably spaced apart, the adjustment of the spacing possibly being obtained by screwing a screw on the rotating shaft of the body;
- The means to adjust the size and shape of the body orifices may exert a mechanical action in relation to the speed of rotation, for example by means of weights arranged in said body so that, in the peripheral region of said body, they exert a pressure that is proportional to the speed of rotation of the solid,
  For this purpose, the body may be arranged between two cups whose peripheral edges converge towards each other;
- The said above weights may be arranged in an annular region of the body and be linked together by a coaxial elastic ring;
- The drive shaft of the body may pass through a chamber delimiting an annular recipient intended to contain the liquid to be sprayed and whose bottom part is provided with liquid dispensing means able to supply a controlled flow of liquid to the body.

BRIEF DESCRIPTION OF THE DRAWINGS

Embodiments of the device according to the invention are described below as non-limiting examples with reference to the appended drawings in which.

Figure 1:
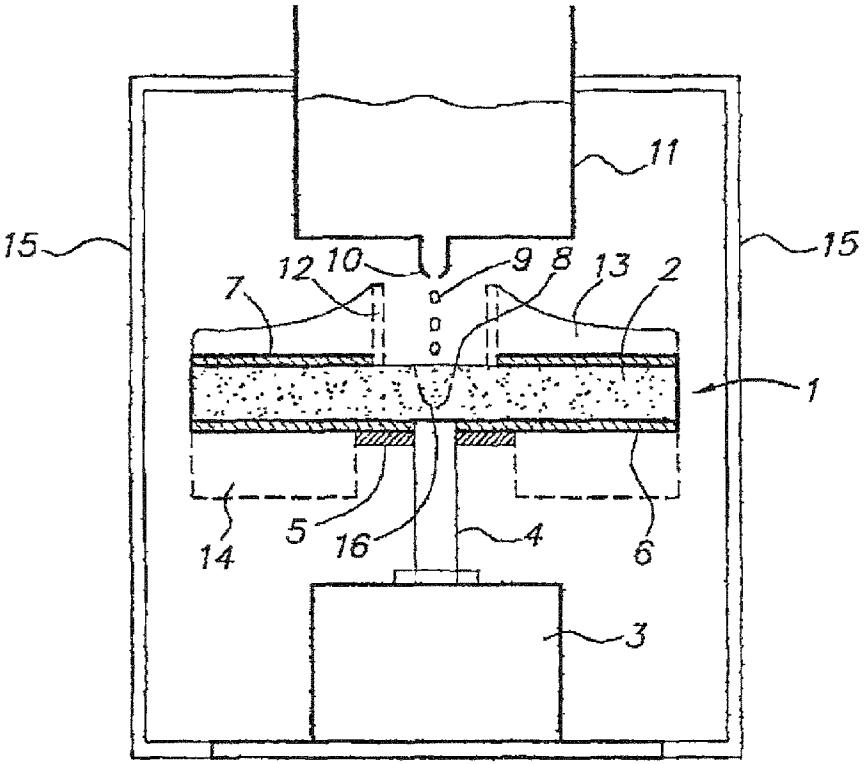
FIG. 1 is a schematic cross-sectional view of a first embodiment of the invention.

In the example shown FIG. 1, the device of the invention has recourse to a horizontal rotor 1 comprising a disk 2 in porous material, for example fibrous, micro-fibrous, alveolar optionally having antiseptic, viricide and/or catalytic properties.

This disk 2 is driven in rotation by an electric motor 3 positioned underneath the disk 2, by means of a coaxial drive shaft 4 and coaxial circular plate 5.

DESCRIPTION OF THE PREFERRED EMBODIMENTS

In this example the lower face of disk 1 is coated with a sealing layer 6 impervious to liquids and gases.

The fixing of disk 2 on the plate 5 is achieved by gluing.

The upper face of the disk 2 is partly coated with a ring-shaped sealing layer 7 which, in its centre, delimits an exposed area 8 used for the intake of liquid.

This liquid is delivered in the form of a succession of drops 9 supplied by an adjustable drip 10 fed from a liquid recipient 11, the assembly being positioned above the disk 2.

Optionally, the liquid intake zone 8 is edged with a feed chute 12 here shown in the form of a tubular sleeve to prevent the drops delivered by the drip from being carried away by the air stream resulting from rotation of the disk 2.

Optionally, the upper face of the disk 2, at the sealing layer 7, is equipped with blades or vanes 13 used to generate a radial air stream on the periphery of the disk.

For a similar purpose, the lower face of the disk may be equipped with similar blades or, as illustrated by the dashed line, with a ring 14 in porous material, e.g. fibrous or alveolar, with open cells.

Optionally, the recipient 11 equipped with the drip 10 may be connected to the motor structure via U-bars 15 or similar.

The functioning of the above-described device is therefore as follows:

The disk 2 is driven in rotation by the motor 3 at a speed in the order of 5000 to 15000 rpm for example (in relation to the diameter of the disk).

In parallel, the drip 10, at an adjustable flow rate, delivers a succession of drops which fall on the intake area 8 of the disk 2.

Each drop 9 is absorbed by a central part of the disk 2 and is distributed therein three-dimensionally under gravity but chiefly by capillarity. In this region, the centrifugal force applied to the liquid is relatively low: it is essentially the capillary forces which fragment the liquid in the thickness and towards the periphery of the disk 2.

The more liquid approaches the periphery of the disk 2, the greater the centrifugal force becomes relaying the capillarity forces and thereby accelerating the radial displacement of the fragmented liquid which nevertheless follows a pathway imposed by the capillary forces.

At the periphery of the disk 2, the centrifugal force exerted by the fragmented liquid is greater than the interaction forces between the liquid and the solid material in rotation. On this account, the fragmented liquid is expelled in the form of fine or very fine droplets which are carried away radially by the airflow generated by the blades 13 and/or ring 14 in porous material.

To facilitate impregnation of the central part of the disk 2 and to increase the fragmenting of the liquid at this level, it is possible to make provision in this central part for a cavity 16 leading to the outside in its upper part at the falling point of the drops 9 delivered by the drip 10.

Similar to the peripheral edge of the disk, the edge of this cavity can assume most varied shapes.

Figure 3:
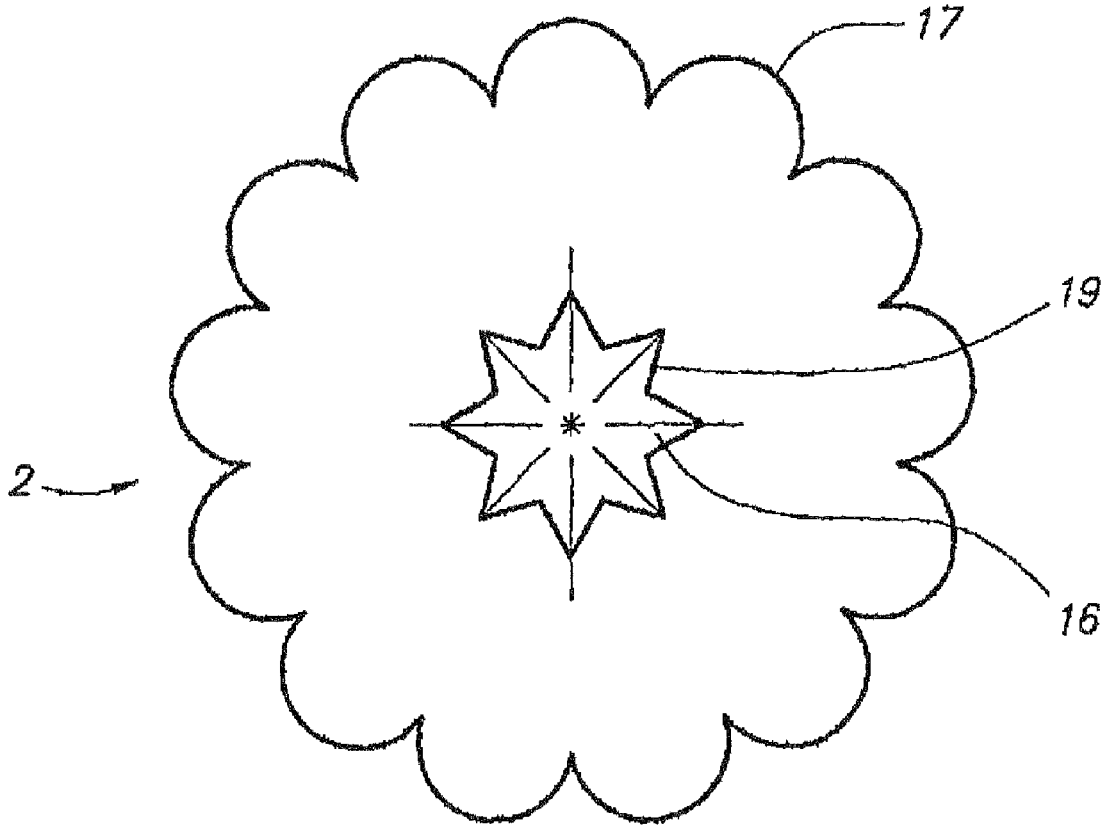
FIG. 3 is an overhead view of the disk used in the devices illustrated FIGS. 1 and 2.

For example, FIG. 3 illustrates polylobate peripheral shapes both for the peripheral surface 17 of the disk and that 19 of the cavity 16.

These shapes allow the intake and outlet surface of the liquid to be considerably increased. Regarding the peripheral surface 17 of the disk 2, this enables the outlet flow rate to be increased and allows eddy currents to be generated which contribute towards increasing the fragmentation of the extracted liquid.

Figure 2:
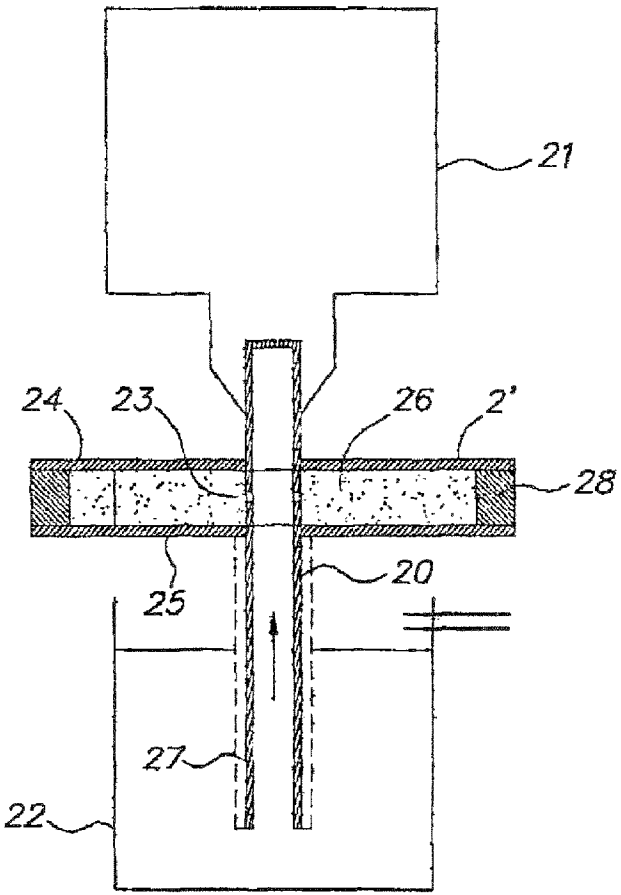
FIG. 2 is a schematic cross-section of a variant of embodiment of the device in FIG. 1.

In the variant of embodiment illustrated FIG. 2, the disk 2' is mounted on a coaxial, hollow rotating shaft 20 driven in rotation in its upper part by an electric motor 21.

This hollow shaft 20 is closed in its upper part, and its lower part is immersed in a liquid contained in a recipient 22.

At the point where it passes through the disk 2', the tubular shaft 20 is provided with at least one side through-hole 23 leading onto the porous material of the disk 2'.

The upper and lower faces of the disk are coated with a layer sealed against liquids 24, 25 and gases. These faces may be provided with means allowing a radial air stream to be generated as in the preceding example (blades or ring in porous material).

The functioning of this device is similar to the preceding device. However, in this case, the rotation of the disk 2', by centrifugal effect, generates a negative pressure inside the hollow shaft 20 and hence aspiration of the liquid contained in the recipient 22. The aspirated flow rate is related to the speed of rotation of the disk 2'. It may be adjusted by calibrating the through-holes 23.

Priming of the rise of liquid can be facilitated through the use of a wick in a material which absorbs the liquid to be sprayed. This wick may be arranged inside or outside the tubular shaft 20.

In both cases, this wick must be in close contact with the rotating material of the disk 2.

Therefore, when stationary, the liquid rises in the wick and comes to impregnate the absorbent material 26 of the disk 2. Owing to the presence of this liquid, when the device is set in operation, this liquid already present in the absorbent material 26 is ejected under the effect of the centrifugal force and, by causing a negative pressure inside the tubular shaft 20 (much greater than that caused by ejection of the gas contained in the disk) ensures priming of the device.

In the example illustrated FIG. 2, the dashed line represents a tubular wick 27 surrounding the tubular shaft 20 and which crosses through layer 25 to reach the absorbent material 26 of the disk 2'.

If the wick occupies the entirety of the inner volume of the hollow shaft, the constituent material of the wick may be chosen so as to conduct separation between liquids of different types. For example, a hydrophilic wick will not allow fatty substances to rise.

As mentioned previously, the constituent material of disk 2' may be heterogeneous and comprise several materials having different physicochemical properties with respect to the liquid to be sprayed.

In the example illustrated FIG. 2, the disk 2' comprises a peripheral region 28 in which the porous or fibrous material has repellent properties with respect to the liquid to be sprayed.

By means of this provision in region 21, the fragmented liquid driven by the centrifugal force will also be subjected to the repelling forces of this material and will undergo additional dispersion (instead of collecting on the surface of the material, it is released from it and is exploded).

Evidently, the invention is not limited to the embodiment just described.

For example, the disk 2, 2' may be replaced by a rotating body of varied shapes, such as propeller blades designed to generate an airflow.

Figure 4:
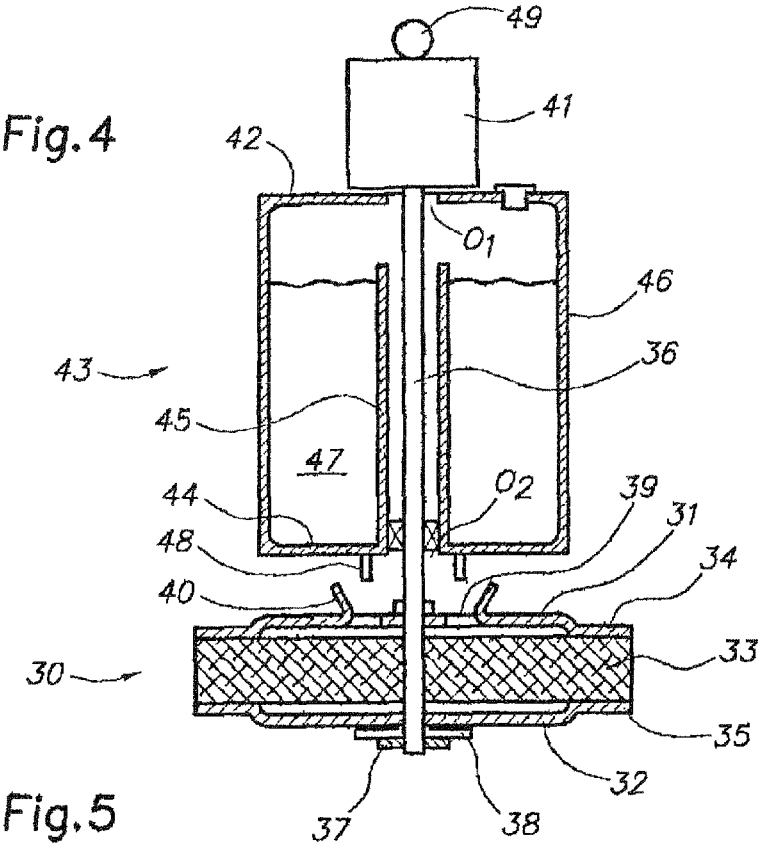
FIG. 4 is a schematic axial section of a dispersion device comprising mechanical adjustment means of droplet size.

In the example illustrated FIG. 4, the dispersion device comprises a rotor 30 having two coaxial disks 31, 32 between which a lining 33 is arranged in porous or fibrous material that is elastically deformable.

These disks 31, 32, each comprise, on their periphery, two rings 34, 35 that are axially offset and connected to the disk by a circular inset.

These two rings 34, 35 are oriented so that come to grip the lining 33 on its periphery.

The securing of the disks 31, 32 on the rotating drive shaft 36 is designed to allow adjustment of the space between the two disks 31, 32.

For example, the disk 31 may be fixedly mounted on the shaft 36, whilst the disk 32 is slidingly mounted on this same shaft 36. The axial maintaining of the disk 32 can then be ensured by means of a screw 37 which screws onto the threaded lower end of the shaft 36, a washer 38 possibly being inserted between them.

The disk 31 comprises a coaxial circular orifice 39 interrupted by radial linking elements.

This circular orifice 39 is bordered by a circular collar 40 which extends radially and slightly outwardly oblique fashion to form a kind of funnel.

The motor 41 used to drive the shaft 36 is secured to the upper part 42 of a chamber 43 which extends into the space lying between the motor 41 and the rotor 30.

For this purpose, the upper 42 and lower 44 faces of the chamber 43 are provided with two respective central, coaxial bore holes $O_1$, $O_2$, through which the shaft 36 passes.

The lower face 44 is provided with a coaxial tubular sleeve 45 opening into orifice $O_2$. The function between the sleeve 45 and the lower face 44 is a sealing junction so that the sleeve 45, the peripheral wall 46 of the chamber 43 and the lower face 44 delimit an annular recipient 47 intended to contain a liquid to be sprayed.

Right above the circular orifice 39, the lower face 44 is provided with at least one bore hole equipped with a drip 48 which may optionally be closable.

The functioning of this device is similar to those previously described.

Its structure allows it to be hung, by a ring 49 for example, which may be provided on the upper face of the motor casing 41.

Nonetheless, the essential advantage of this apparatus lies in the possible adjustment of the size of the droplets generated by the rotor 30.

For this purpose, all that is required is to vary the spacing between the two disks 31, 32 by screwing or unscrewing the screw 37 depending on the desired result.

This screwing or unscrewing causes a compression or expansion of a peripheral zone of the lining 33, and consequently varies (narrowing/expansion) the orifices through which the fluid passes in said zone.

This variation causes a corresponding variation in the size of the droplets, independently of the speed of rotation of the rotor 30.

Figure 5:
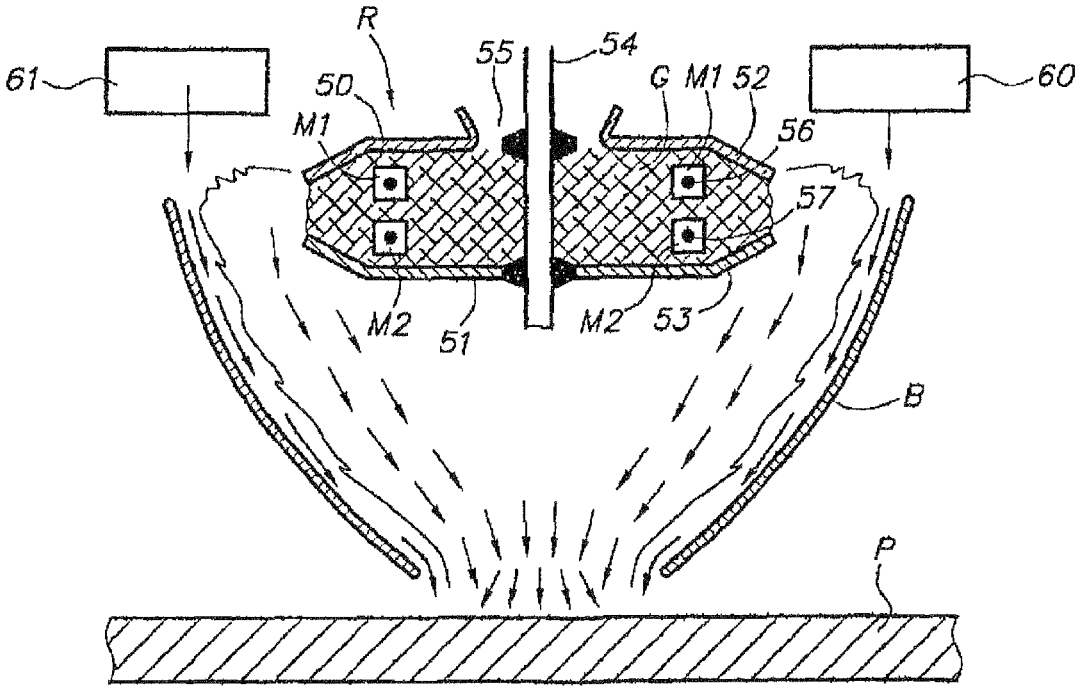
FIG. 5 is an axial section of the rotor of a dispersion device with self servo-control for adjustment of droplet size.

In the example illustrated FIG. 5, the rotor R comprises two coaxial cups 50, 51 delimiting between them a space which encloses a lining G in an elastically deformable material.

The two cups 50, 51 each comprise a flanged peripheral zone 52, 53 for example of substantially truncated cone shape, and are arranged so that their concavities face one another.

The two cups 50, 51 are mounted fixedly on a drive shaft in coaxial rotation 54.

The two cups delimit a space which becomes increasingly narrower at the flanged peripheral zones.

As in the example previously described, the upper cup 50 comprises a circular orifice 55 intended to receive drops of the liquid to be sprayed, this circular orifice 55 being edged by a circular collar 56 similar to collar 40.

Also, inside the lining G two series of weights $M_1$, $M_2$ are arranged each in an annular region located in the vicinity of the flanged peripheral zones 52, 53.

The weights $M_1$, $M_2$ of each of the series are connected together by an elastic coaxial ring 56, 57.

The functioning of this device is as follows:

When the rotor R is driven in rotation at constant speed, the centrifugal force exerted on the weights $M_1$, $M_2$ causes their displacement and consequently a compressive action of the lining G between the flanged zones 52, 53.

On this account, in this zone the liquid passage orifices have smaller sections than when the rotor R was stationary.

An increase in the speed of rotation of the rotor R will cause a reduction in the section of the passage orifices and hence a reduction in the size of the droplets generated by the rotor. In parallel, the flow rate of the sprayed liquid (which undergoes a twofold phenomenon of accelerated liquid flow rate owing to the increased rotation speed, and slowing due to the increased load loss when passing through the compressed zone of the lining) will be maintained substantially constant, and may even decrease slightly.

On the contrary, a reduction in the rotation speed of the rotor R will cause an increase in the section of the above-said orifices and hence a reduction in the liquid flow rate. Here too the flow rate of the liquid remains substantially constant, with a widened droplet section.

In this example, the rotor R is arranged in a spray nozzle B that is funnel-shaped on whose walls an air stream is injected derived from generation means such as a fan or turbine, here indicated by blocks 60, 61.

Therefore the fog generated by the rotor R is driven into the nozzle B without touching its walls.

It is then ejected from the nozzle B to be applied to a wall P. The outlet section of the nozzle B may be of any shape (e.g. circular, square, rectangular, oblong, etc. . . . ) as appropriate for the desired application.

Said solution may be suitable for numerous utilisations such as painting (an alternative to a paint gun), plant treatment, etc. . . . Evidently the type of liquid must be adapted to the type of treatment.

Evidently, the air stream generation means may consist of a turbine or turbine blades associated with the rotor.

The invention claimed is:

1. A method to disperse a liquid, consisting of subjecting the liquid to the dispersing action of forces which develop spontaneously at the interface between a liquid and a solid, and of causing the solid to rotate so as to subject the dispersed liquid to a centrifugal force causing its extraction and spraying into the surrounding medium in the form of drops, droplets, ultra-fine droplets, vapour, wherein the solid is heterogeneous and comprises a fraction exerting an interactive attraction force on the liquid, and a fraction exerting an interactive repelling force on the liquid, and wherein the supply of liquid to the solid is ensured by aspiration due to the centrifugal force exerted on the solid.

2. A method to disperse a liquid, consisting of subjecting the liquid to the dispersing action of forces which develop spontaneously at the interface between a liquid and a solid, and of causing the solid to rotate so as to subject the dispersed liquid to a centrifugal force causing its extraction and spraying into the surrounding medium in the form of drops, droplets, ultrafine droplets, vapour, wherein the solid is heterogeneous and comprises a fraction exerting an interactive attraction force on the liquid, and a fraction exerting an interactive repelling force on the liquid, and wherein the supply of liquid to the solid is ensured by capillarity, by a porous or fibrous or powder material having the required affinities with the liquid for the phenomenon of capillarity to develop.

3. A device comprising a rotating body in solid material, rigid or flexible, means for driving in rotation said body and a liquid intake in contact with said body, wherein the solid comprises a body in compressible porous or fibrous material having orifices on its periphery for passing of liquid, and said means for driving serving to adjust the size and shape of said orifices.

4. A device according to claim 3, wherein the body has symmetrical outer shapes relative to its axis of rotation.

5. A device according to claim 3, wherein the radial faces of the body are at least partly coated or impregnated with a sealing layer.

6. A device according to claim 3, wherein the body is rotatably mounted via a tubular drive shaft used to supply it with liquid, and in that in this case the liquid intake in said body is achieved by the aspiration generated by the centrifugal forces exerted on the liquid inside the body and/or by assistance using capillarity and/or pumping.

7. A device according to claim 6, wherein the priming of liquid rise is facilitated by the use of an absorbent wick secured to the inside or outside of the tubular shaft, this wick being in close contact with the absorbent material of the disk.

8. A device according to claim 7, wherein the wick is chosen so as to conduct separation between liquids of different types.

9. A device according to claim 3, wherein the liquid intake on the body is made by gravity by a dispenser, optionally a drip dispenser arranged above the body.

10. A device according to claim 9, wherein, to facilitate impregnation of the central part of the disk and to increase fragmenting of the liquid at this point, it is possible to make provision in this central part for a cavity leading outwardly in its upper part at the dropping point of the drops delivered by the drip.

11. A device according to claim 10, wherein the peripheral edge of the disk and/or of the cavity may be of varied shapes.

12. A device according to claim 3, wherein the body comprises a disk in porous material, optionally having antiseptic, viricide and/or catalytic properties.

13. A device according to claim 12, wherein at least one of the radial faces of the disk is equipped with blades or vanes or with a ring in porous material optionally fibrous or alveolar with open cells.

14. A device according to claim 12, wherein the constituent material of the disk is heterogeneous and comprises several materials having different physicochemical properties with respect to the liquid to be sprayed.

15. A device according to claim 14, wherein the disk comprises a peripheral region in which the porous or fibrous material has repellent properties with respect to the liquid to be sprayed.

16. A device according to claim 12, wherein the porous material of the disk is fibrous, micro-fibrous, alveolar.

17. A device according to claim 3, wherein said means for driving exert an adjustable, pemianent mechanical action on the body so as to generate compression or expansion of the material of the body at least on its periphery.

18. A device according to claim 17, wherein said body is arranged between two disks with adjustable spacing.

19. device according to claim 18, wherein the adjustment of said spacing is obtained by screwing a screw on the rotating shaft of the body.

20. A device according to claim 3, wherein said means for driving exert a mechanical action in relation to the rotation speed of the body.

21. A device according to claim 20, wherein said means for driving comprise weights arranged in said body so that, in the peripheral region of said body, they exert a pressure that is proportional to the rotational speed of the solid.

22. A device according to claim 21, wherein said body is arranged between two coaxial cups arranged so that their concavities face one another, these two cups being fixedly mounted on a drive shaft in coaxial rotation, and wherein said weights are arranged so as to compress said body against the peripheral edges of said cups.

23. A device according to claim 22, wherein said weights are arranged in at least one coaxial annular region of the body and are connected together by a coaxial elastic ring.

24. A device according to claim 3, comprising means for enabling an airflow to be generated to channel the fog generated by the body.

25. A device according to claim 3, wherein said above solid is joined to a rotor driven by a drive shaft coupled to a motor, wherein said motor is secured to an upper wall of a chamber, whilst the drive shaft successively passes through two orifices respectively provided in the upper wall and lower wall of the chamber, and through a coaxial tubular sleeve sealingly attached onto a lower face of the chamber, said sleeve, said lower face and a side face of the chamber delimiting a reservoir used to receive the liquid to be sprayed, means being provided so as to bring controlled quantities of liquid in contact with said solid, during rotation of the rotor.

26. A device according to claim 3, wherein the solid material of the rotating body is fibrous, micro-fibrous, porous, cellular, micro-cellular.

* * * * *